US006756963B2

(12) United States Patent
Frazee et al.

(10) Patent No.: US 6,756,963 B2
(45) Date of Patent: Jun. 29, 2004

(54) HIGH CONTRAST LCD MICRODISPLAY

(75) Inventors: Jerome A. Frazee, Milpitas, CA (US); Russell Flack, Scottsdale, AZ (US); Joseph T. Smith, Chandler, AZ (US)

(73) Assignee: Three-Five Systems, Inc., Tempe, AZ (US)

( * ) Notice: Subject to any disclaimer, the term of this patent is extended or adjusted under 35 U.S.C. 154(b) by 313 days.

(21) Appl. No.: 09/966,063

(22) Filed: Sep. 28, 2001

(65) Prior Publication Data

US 2003/0063055 A1 Apr. 3, 2003

(51) Int. Cl.[7] ..... G09G 3/36
(52) U.S. Cl. ..... 345/100; 345/99
(58) Field of Search ..... 345/90, 87, 98, 345/99, 100, 204, 205, 212, 213; 327/108, 141, 100, 102, 365

(56) References Cited

U.S. PATENT DOCUMENTS 5,440,153 A * 8/1995 Male et al. ..... 257/204
5,739,803 A * 4/1998 Neugebauer ..... 345/98
5,903,246 A * 5/1999 Dingwall ..... 345/82
6,356,029 B1 * 3/2002 Hunter ..... 315/169.1
6,359,605 B1 * 3/2002 Knapp et al. ..... 345/76
6,411,269 B1 * 6/2002 Zimlich ..... 345/75.2

* cited by examiner

*Primary Examiner*—Kent Chang
(74) *Attorney, Agent, or Firm*—Ingrassia Fisher & Lorenz, P.C.

(57) ABSTRACT

An LCD micro display for generating an image of a video signal includes a matrix of pixels arranged in a plurality of rows and a plurality of columns, which are selectively energized to create the image. The rows are connected to a row select circuit for energizing each of the rows in accordance with a first predetermined sequence. The columns are coupled to a column select circuit coupling the video signal to each of the columns in accordance with the second predetermined sequence. The column select circuit includes a plurality of video switches, each of which include a high speed current mirror level shifter for shifting the control signal from a first potential to a second higher potential. A transmission gate couples the video signal to one of the columns upon receipt of the higher potential control signal.

21 Claims, 3 Drawing Sheets

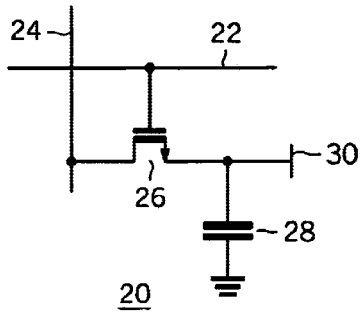
FIG. 1
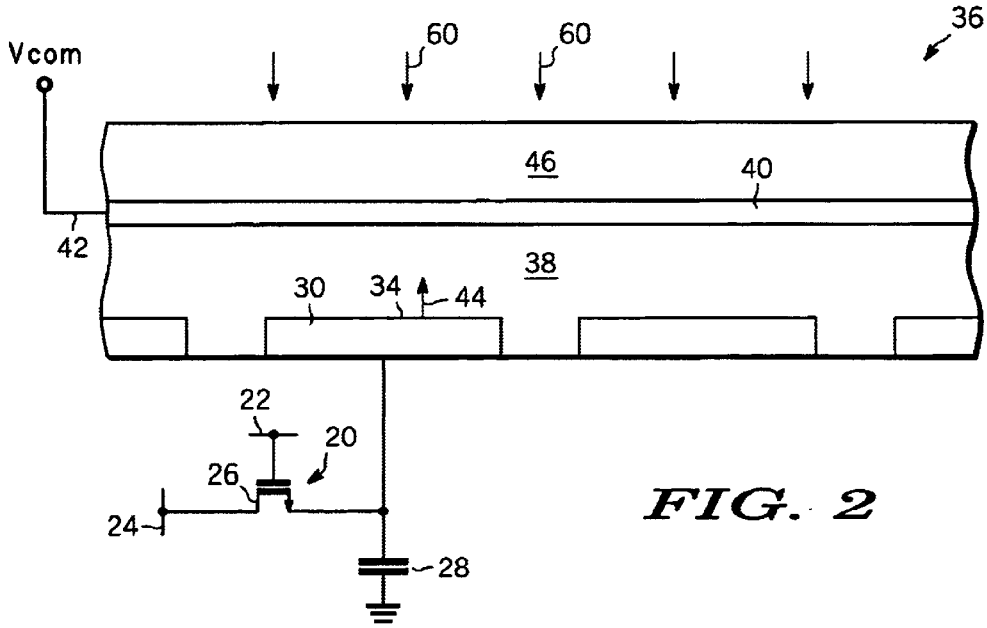
FIG. 2
FIG. 3
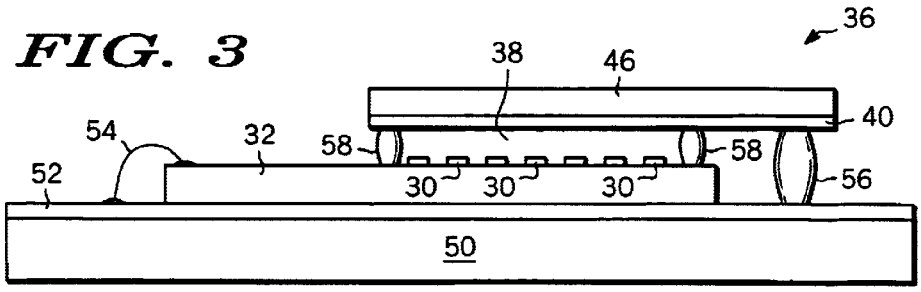

HIGH CONTRAST LCD MICRODISPLAY

TECHNICAL FIELD

This invention relates generally to a liquid crystal display (LCD), and more particularly to a high contrast LCD microdisplay utilizing compensated high-speed column video switches.

BACKGROUND OF THE INVENTION

For many decades, the cathode ray tube (CRT) was the dominant display device creating an image by scanning a beam of electrons across a phosphor-coated screen causing the phosphors to emit visible light. The beam is generated by an electron gun and is passed through a deflection system that causes the beam to rapidly scan left-to-right and top-to-bottom. A magnetic lens focuses the beam to create a small moving dot on the phosphor screen. This rapidly moving spot of light paints an image on the surface of the viewing screen.

Light emitting diodes (LEDs) have also found a multitude of uses in the field of optoelectronics. An LED is a solid-state device capable of converting a flow of electrons into light. By combining two types of semiconductive material, LEDs emit light when electricity is passed through them. Displays comprised of LEDs may be used to display a number of digits each having seven segments. Each segment consists of a group of LEDs, which in combination can form alphanumeric images. They are commonly used in, for example, digital watch displays, pager displays, cellular handset displays, etc., and due to their excellent brightness, LEDs are often used in outdoor signs. Generally speaking, however, they have been used primarily in connection with non-graphic, low-information-content alphanumeric displays. In addition, in a low-power CMOS digital system, the dissipation of LEDs or other comparable display technology can dominate the total system's power requirements, which could substantially negate the low-power dissipation advantage of CMOS technology.

Liquid crystal displays (LCDs) were developed in the 1970s in response to the inherent limitations in the then existing display technologies (e.g. CRTs, LED displays, etc.) such as excessive size, limited useful life, excessive power consumption, and limited information content. LCD displays comprise a matrix of pixels that are arranged in rows and columns that can be selectively energized to form letters or pictures in black and white or in a wide range of color combinations. An LCD modifies light that passes through it or is reflected from it as opposed to emitting light, as does an LED. An LCD generally comprises a layer of liquid crystalline material suspended between two glass plates or between a glass plate and a substrate. A principle advantage of an LCD over other display technologies is the ability to include thousands or even millions of pixels in a single display paving the way for much greater information content.

With the shift from segmented, very low information content displays to more information-rich digital products, LCDs now appear in products throughout the communications, office automation, and industrial, medical, and commercial electronics industries. Historically, the market for small displays has demanded low cost, minimal power consumption, and high image quality. To assure high quality, high contrast images, it is necessary that the voltage stored on the pixel capacitors match, as closely as possible, the original source video signal voltage. Thus, the video signal must not be distorted when the source video signal coupled to each of the individual columns of pixels is switched on and off. For example, in a CMOS microdisplay, distortion of the video may be caused by what is commonly referred to as charge injection and clock feed-through occurring when an NMOS access transistor column-switch enable signal is turned off.

In view of the foregoing, it should be appreciated that it would be desirable to provide a high-contrast, high-quality LCD microdisplay wherein the video image stored on the pixel capacitors matches the original source video signal. This is accomplished by utilizing a high-speed CMOS column video switches that include compensating transistors for injecting opposite charge onto the video line when the column video switch turns off. Additional desirable features will become apparent to one skilled in the art from the foregoing background of the invention and the following detailed description of a preferred exemplary embodiment and appended claims.

SUMMARY OF THE INVENTION

In accordance with the teachings of the present invention, there is provided an LCD display for generating an image of a video signal that includes a matrix of pixels arranged in a plurality of rows and a plurality of columns, which are selectively energized to create the image. The rows are connected to a row select circuit for energizing each of the rows in accordance with a first predetermined sequence. The columns are coupled to a column select circuit that couples the video signal to each of the columns in accordance with the second predetermined sequence. The column select circuit includes a plurality of video switches, each of which include a high speed current mirror level shifter for shifting the control signal from a first potential to a second higher potential, and a transmission gate for coupling the video signal to one of the columns upon receipt of the higher potential control signal.

BRIEF DESCRIPTION OF THE DRAWINGS

The present invention will hereinafter be described in conjunction with the accompanying drawings wherein like reference numerals denote like elements, in which:

FIG. 1 is a schematic diagram of a single analog pixel cell;

FIG. 2 is a simplified functional diagram illustrating how pixel circuitry interacts with pixel mirrors and the remainder of an LCD micro display;

FIG. 3 is a simple cross-sectional view showing major components of an LCD micro display;

DESCRIPTION OF THE PREFERRED EXEMPLARY EMBODIMENT

Figure 4:
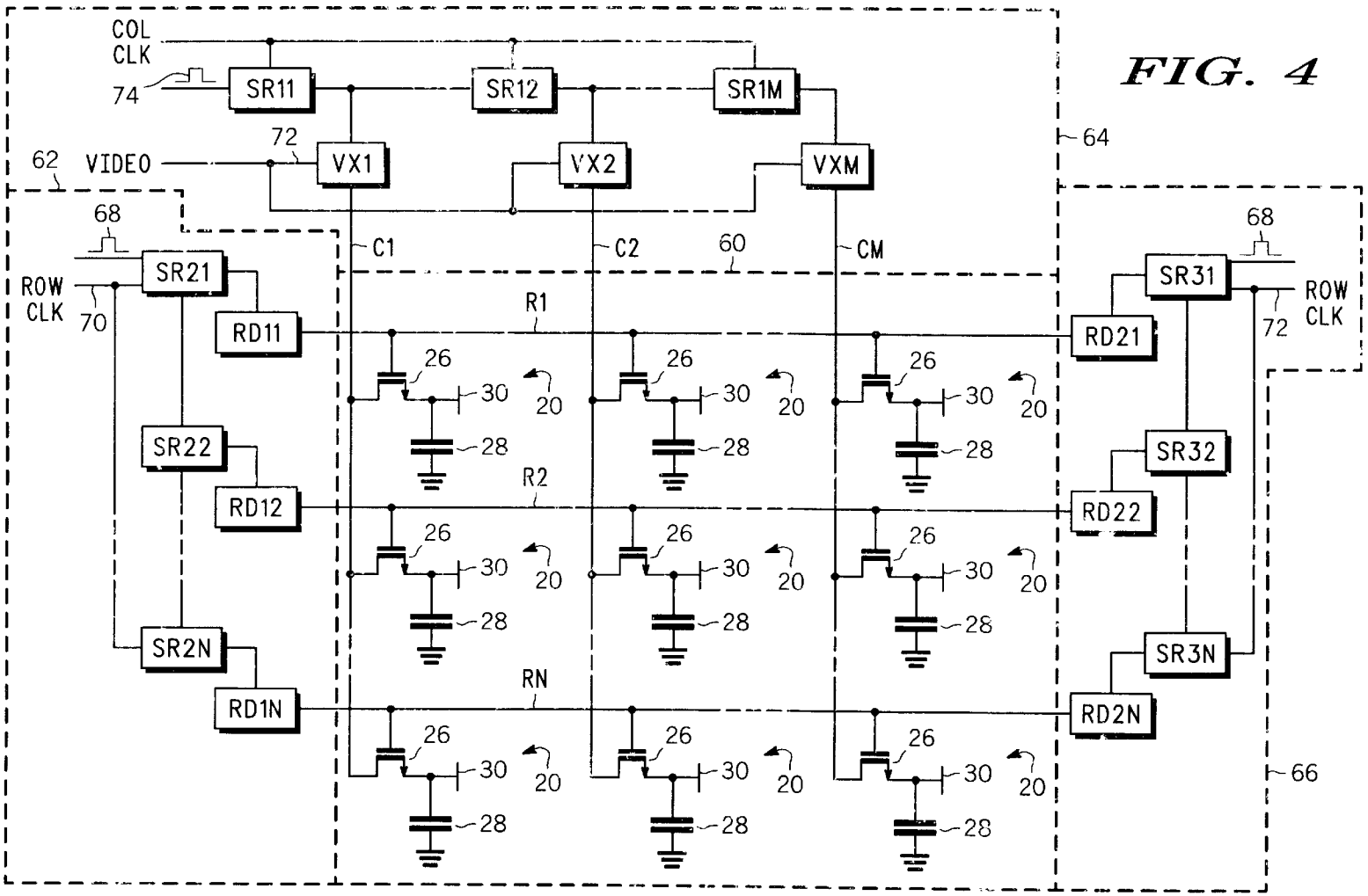
FIG. 4 is a partial schematic/partial block diagram of an N×M LCD display utilizing video switches in accordance with the present invention.

The following detailed description of a preferred embodiment is mainly exemplary in nature and is not intended to limit the invention or the application or use of the invention.

The present invention recognizes that to produce a high quality, high contrast image of a video signal, the image voltage stored on the pixel capacitors must match as closely as possible the original source video signal and that it would be desirable to prevent the video signal from being distorted whenever the video signal coupled to each of the individual columns of pixels is switched on and off. In the case of NMOS transistor switches, distortion of the video signal may be caused by what is commonly referred to as charge-injection and clock feed through. To prevent distortion of the column video signal, an inventive CMOS column video switch utilizes n-channel and p-channel field-effect-transistors placed in parallel and compensation transistors forming a compensated transmission gate. This CMOS transmission gate approach will reduce the effects of charge-injection and clock-feed-through. The compensation transistors are utilized to inject opposite charge into the column line whenever the CMOS video switch turns off, restoring the column video signal level to its original input level by canceling out the charge-injection and clock-feed through effects.

FIG. 1 is a schematic diagram of an individual pixel 20 coupled to a row line 22 and a column line 24. Of course it should be understood, that an actual LCD micro display would include a large matrix of row lines 22, column lines 24, and pixels 20. Each pixel includes an access n-channel field-effect-transistor 26, which has a gate coupled to row line 22 and a drain coupled to column line 24. The source of access transistor 26 is coupled to a first terminal of pixel capacitor 28 and to pixel mirror 30, the function of which will be described more fully in connection with FIG. 2. The other terminal of capacitor 28 is coupled to a source of potential; e.g. ground.

FIG. 2 is a simplified functional diagram illustrating how each pixel 20 interacts with an associated mirror 30 to create a liquid crystal image. FIG. 3 is a simplified cross-sectional view of a liquid crystal display that likewise will be useful in explaining the operation of a liquid crystal micro display. In both cases, like reference numerals denote like elements. Referring to both FIG. 1 and FIG. 2, pixel 20, described in connection with FIG. 1, is again shown coupled to mirror 30, a plurality of which reside on the surface of a semiconductor substrate (e.g. silicon) 32 as is shown in FIG. 3. Mirrors 30 may be metallic (e.g. aluminum) and have a thickness of, for example, 2000 angstroms, and each has a reflective surface 34 that may or may not have enhanced reflective properties. When row line 22 is asserted, transistor 26 becomes conductive, thus permitting the video signal (e.g. a analog video signal) appearing on column line 24 to charge pixel capacitor 28. Thus, the voltage on mirror 34 will vary in accordance with the voltage across pixel capacitor 28. Located within region 38 is a liquid crystal material, the molecules of which orient themselves in a relationship that depends on the voltage applied. A glass seal 46 is provided under which a layer of indium-tin-oxide (ITO) 40 is provided which is a transparent conductive material to which a potential $V_{com}$ is applied as is shown at 42. $V_{com}$ may, for example, be approximately 7 volts. The voltage stored across pixel capacitor 28 and therefore the voltage on mirror 34 may approach a much higher voltage (e.g. 17–18 volts) thus placing a significant potential difference between mirror 34 and ITO layer 40 and causing the molecules of the liquid crystal material in region 38 to assume a first orientation corresponding to black. Alternatively, if the voltage stored across pixel capacitor 28 is low, thus reducing the potential difference between mirror 30 and ITO layer 40, the molecules of the liquid crystal material in region 38 will assume a different orientation (e.g. corresponding to white). That is, a high voltage on mirror 30 may cause the molecules of the liquid crystal material to substantially prevent light (indicated by arrow) 44 from being reflected from mirror surface 34 while a lower voltage on mirror 30 will permit light 44 to be reflected.

Mirrors 30 reside on the surface of a semiconductor substrate (e.g. silicon) 32, which has deposited therein or formed thereon all the active regions (e.g. pixel capacitors, access transistors, etc.) required to produce a working device. Semiconductor die is supported by a substrate 50 (e.g. ceramic) which may have a flexible printed circuit board 52 disposed thereon for the purpose of making external connection to semiconductor die 32 and ITO layer 40 by, for example, wire bond 54 and conductive epoxy crossover 56. Finally, a perimeter seal 58 is provided between the surface of semiconductor dye 32 and the surface of ITO layer 40 to seal the liquid crystal material within region 38.

In operation, ambient or generated light (indicated by arrows 60) impinges upon and passes through transparent glass layer 46 and ITO layer 40. If the potential difference between mirror 30 and ITO layer 42 is high, virtually no light will be reflected from surface 34 of mirror 30 and therefore that portion of the video image created by pixel 20 will approach black. If, on the other hand, the potential difference between mirror 30 and ITO layer 42 is very low, virtually all of the light 60 striking surface 34 will be reflected and that portion of the video image to be created by pixel 20 will approach white. It should be clear that between these two extremes, there are a multiple of shades extending from white to black, which may be displayed depending on the magnitude of the video voltage stored on pixel capacitor 28 and applied to mirror 30. Since the operation and structure of liquid crystal micro displays is well known and well documented in technical literature. For example, see U.S. Pat. No. 3,862,360 entitled "Liquid Crystal Display System With Integrated Signal Display Storage Circuitry" issued Jan. 21, 1975 and assigned to Hughes Aircraft Company, the teachings of which are hereby incorporated by reference.

FIG. 4 is a partial schematic/partial block diagram of an N×M LCD micro display utilizing video switches in accordance with the teachings of the present invention. As can be seen, the apparatus of FIG. 4 comprises an N×M matrix 60 of video pixels 20 (only several of which are shown for clarity), a plurality of rows R1, R2, . . . , RN, and a plurality of columns C1, C2, . . . , CM. The apparatus also includes a first row select circuit 62, a first column select circuit 64 and optionally a second row select circuit 66. Row select circuit 62 includes a shift register containing bits SR21, SR22, . . . , SR2N, the output of each of which is respectively coupled to a plurality of row drivers RD11, RD12, . . . RD1N. Similarly, column select circuit 64 includes a serial shift register comprised of bits SR11, SR12, . . . , SR1M each having outputs coupled respectively to video switches VX1, VX2, . . . , VXN.

As is well known in the art, the pixels coupled to the columns and rows are scanned in order to create an LCD image. The following is one example of how this scanning process is accomplished. Starting with row select circuitry 62, shift register bit SR21 has a signal 68 applied to an input thereof. Under the control of a row clock applied to the clock input 70 of bit SR21 and to the clock inputs of each successive stage SR22, . . . , SR2N, signal 68 is propagated through the shift register. The output of each shift register bit is coupled to a corresponding row driver RD11, RD12, . . . , RD1N each of which is sequentially energized as signal 68 propagates through the bits of the shift register. This process in turn sequentially asserts rows R1, R2, . . . , RN.

Column select circuit 64 likewise comprises a shift register comprised of shift register bits SR11, SR12, . . . , SR1M each of which has an output coupled respectively to a plurality of column video switches VX1, VX2, . . . , VXM.

The output of each video switch VX1, VX2, . . . , VXM is coupled respectively to columns C1, C2, . . . , CM. Each video switch also has an input for receiving the video signal to be displayed as is shown at 72. A pulse signal 74 is applied to the input of the first shift register bit SR11, and through the action of a column clock which is applied to the clock inputs of each of the shift register bits SR11, SR12, . . . , SR1M, pulse 74 is serially clocked through successive bits of the shift register. Thus, each of the video switches VX1, VX2, . . . , VXM each has an input which is respectively coupled to a corresponding output of a shift register bit for sequentially applying the video signal appearing at 72 to each of the column lines C1, C2, . . . , CM.

If desired, a second row select circuit 66 may be provided to drive the row lines at their opposite ends in order to provide a greater drive capacity. Circuit 66 includes a shift register comprised of stages SR31, SR31, . . . , SR3M and a plurality of row drivers RD21, RD22, . . . , RD2N. SR31 receives the same input signal 68 and row clock at 72 so as to operate synchronously with row select circuit 62. Thus, instead of driving the matrix rows from only one end and propagating the drive signal down the entire row, each row is driven at both ends to improve performance.

Figure 5:
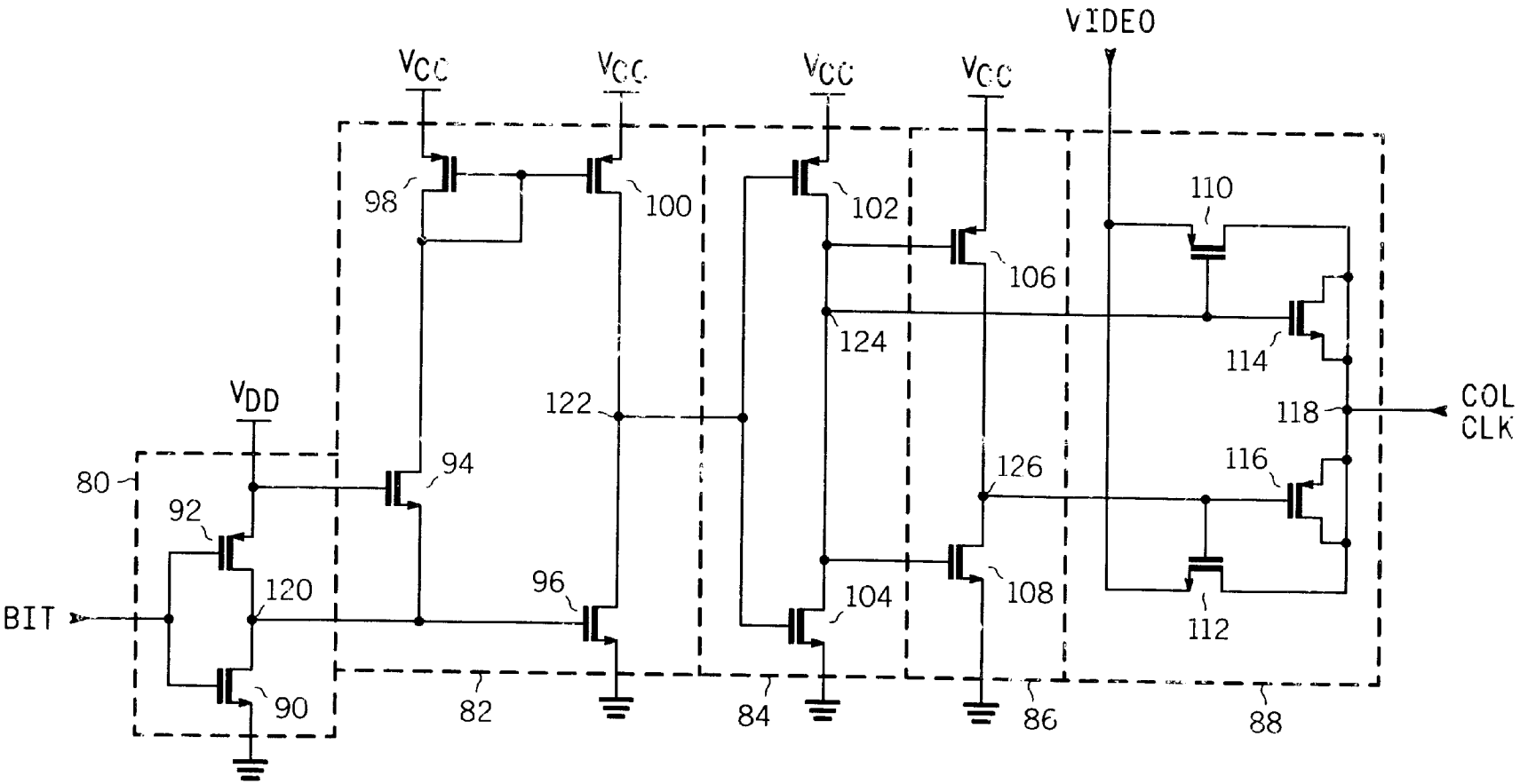
FIG. 5 is a schematic diagram of a CMOS video switch circuit for use in the LCD display shown in FIG. 4.

As stated previously, it is important to assure that the video voltage stored on the pixel capacitors match the original source video signal; that is, the distortion of the video caused by charge injection and clock feed-through when the video column switches are turned off must be minimized. FIG. 5 is a schematic diagram of a CMOS video switch circuit for use in conjunction with the LCD display shown in FIG. 4 which reduces these unwanted distortion effects. The circuit comprises a first inverter 80, a current mirror level shifter 82, a second inverter 84, a third inverter 86, and a compensating transmission gate 88. Inverter 80 comprises a low voltage n-channel field-effect-transistor 90 and p-channel field-effect-transistor 92 each having a gate coupled to receive a low voltage control signal (BIT) corresponding to the output of one of the shift register stages SR11, SR12, . . . , SR1M shown in FIG. 4. The source of field-effect-transistor 92 is coupled to receive a first potential (VDD, for example 3 volts), and the source of field-effect-transistor 90 is coupled to receive a second potential (e.g. ground). The drains of field-effect-transistor 90 and 92 are coupled in common.

Current mirror level shifter 82 is comprised of high voltage n-channel field-effect-transistors 94 and 96, diode coupled p-channel field-effect-transistor 98, and p-channel field-effect-transistor 100. N-channel field-effect-transistor 94 has a gate coupled to receive VDD, a source coupled to the output of inverter 80 (i.e. the common drain of field-effect-transistors 90 and 92), and a drain coupled to the drain of p-channel field-effect-transistor 98. The gate of p-channel field-effect-transistor 98 is coupled to its drain and to the gate of p-channel field-effect-transistor 100. The source of n-channel field-effect-transistor 96 is coupled to a source of potential (e.g. ground), and the drain of n-channel field-effect-transistor 96 is coupled to the drain of p-channel field-effect-transistor 100 forming the output of current mirror level shifter 82. The sources of both transistors 98 and 100 are coupled to receive a third potential VCC (e.g. 18 volts).

Inverter 84 is comprised of p-channel field-effect-transistor 102 and n-channel field-effect-transistor 104 each having their gate electrodes coupled to the output of current mirror level shifter 82 (i.e. the drains of transistors 96 and 100). The drain of p-channel field-effect-transistor 102 is coupled to the drain of n-channel field-effect-transistor 104 forming the output of inverter 84. The source of p-channel field-effect-transistor 102 is coupled to VCC, and the source of n-channel field-effect-transistor 104 is coupled to, for example, ground.

Inverter 86 is comprised of p-channel field-effect-transistor 106 and n-channel field-effect-transistor 108, each having a gate coupled to the output of inverter 84 (i.e. the drains of p-channel field-effect-transistor 102 and n-channel field-effect-transistor 104). The source of p-channel field-effect-transistor 106 is coupled to VCC, and the source of n-channel field-effect-transistor 108 is coupled to, for example, ground. The drain of transistors 106 and 108 are coupled together and form the output of inverter 86.

Compensated transmission gate 88 is comprised of p-channel field-effect-transistor 110 having a gate coupled to output of inverter 84, n-channel field-effect-transistor 112 having a gate coupled to the output of inverter 86, n-channel field-effect-transistor 114 having a gate coupled to gate of p-channel field-effect-transistor 110, and p-channel field-effect-transistor 116 having a gate coupled to gate of n-channel field-effect-transistor 112. The source electrodes of p-channel field-effect-transistor 110 and n-channel field-effect-transistor 112 are coupled to receive a video signal of the type that is applied to the video switches VX1, VX2, . . . , VXM shown in FIG. 4. The drains of p-channel field-effect-transistor 110 and n-channel field-effect-transistor 112 and both the drain and source electrodes of n-channel field-effect-transistor 114 and p-channel field-effect-transistor 116 are coupled to the output 118 corresponding to a selected column line in FIG. 4. It should be clear that p-channel field-effect-transistor 110 and n-channel field-effect-transistor 112 function as a transmission gate for passing the video signal to the column line. N-channel field-effect-transistor 114 and p-channel field-effect-transistor 116 are compensating transistors to minimize the effects of clock feed-through and charge injection as described earlier.

The video switch circuit shown in FIG. 5 operates as follows. When the control signal (BIT) goes high, field-effect-transistor 90 turns on causing node 120 to go low. With the source of transistor 94 low and its gate coupled to VDD, transistor 94 turns on causing current to flow through diode coupled to transistor 98. As a result of the current mirror configuration, current also flows through transistor 100 causing the voltage at node 122 to go high (transistor 96 is off). With a high at the gate electrodes of transistors 102 and 104, transistor 104 turns on causing node 124 to go low. This signal is applied to the gate of p-channel field-effect-transistor 110 causing it to turn on and couple the video signal to output node 118. Since the output of inverter 84 is coupled to the gate electrodes of transistors 106 and 108, transistor 106 turns on while transistor 108 remains off causing the voltage node 126 to go high. This in turn turns on transistor 112 thus also passing the video signal on to output node 118. In this state, the video signal is applied to a selected column shown in FIG. 4.

When the control signal (BIT) goes low, transistor 96 turns on causing node 122 to go low. This produces a high voltage at node 124 of inverter 94 and a low voltage at node 126 of inverter 86. This combination of signals causes both transmission gate transistors 110 and 112 to turn off, decoupling the video signal from output node 118. However, as transistors 110 and 112 turn off, compensation transistors 114 and 116 turn on to reduce the column video voltage offsets effects of charge injection and clock-feed-through at node 118.

From the foregoing description, it should be appreciated that a CMOS video switch and a liquid crystal display incorporating same has been provided which minimizes the effects of charge injection and clock feed-through so as to help assure that the video image stored on the LCD pixel capacitors matches the original digital source video signal. While a preferred exemplary embodiment has been presented in the foregoing detailed description, it should be appreciated that a vast number of variations in the embodiments exist. It should also be appreciated that this preferred embodiment is only an example and is not intended to limit the scope, applicability or configuration of the invention in any way. Rather, the foregoing detailed description provides those skilled in the art with a convenient roadmap for implementing the preferred exemplary embodiment of the invention. Various changes may be made in the function and arrangement described above without departing from the spirit and scope of the invention as set forth in the appended claims.

What is claimed is:

1. A video switch for coupling a video signal to a column line of a liquid crystal display upon the occurrence of a first control signal, comprising:

a current mirror level shifter having an input coupled to receive said control signal for shifting said control signal from a first potential to a second potential at an output thereof; and a transmission gate coupled to said current mirror level shifter for coupling said video signal to said column line upon receipt of said control signal having said second potential.

2. A video switch according to claim 1 further comprising an output compensating circuit coupled to said transmission gate for improving the integrity of said video signal at said column line.

3. A video switch according to claim 2 further comprising a first inverter having an input coupled to receive said control signal and having an output coupled to the input of said current mirror level shifter.

4. A video switch according to claim 3 further comprising:

a second inverter having an input coupled to the output of said current mirror level shifter and having an output coupled to said transmission gate; and a third inverter having an input coupled to the output of said second inverter and having an output coupled to said transmission gate.

5. A video switch according to claim 4 wherein said current mirror level shifter comprises:

a first n-channel field-effect-transistor having a gate for coupling to a first potential, a drain coupled to the output of said first inverter, and having a drain;

a second p-channel field-effect-transistor having a drain coupled to the drain of said first n-channel field-effect-transistor and to the gate of said second p-channel field-effect-transistor, and having a source for coupling to a second potential, said second potential being higher than said first potential;

a third n-channel field-effect-transistor having a gate coupled to the output of said first inverter and to the source of said first n-channel field-effect-transistor, a source for coupling to a third potential, and a drain coupled to the output of said current mirror level shifter; and a fourth p-channel field-effect-transistor having a gate coupled to the gate of said second p-channel field-effect-transistor, a source for coupling to said second potential, and a drain coupled to the drain of said third n-channel field-effect-transistor and to the output of said current mirror level shifter.

6. A video switch according to claim 5 wherein said transmission gate comprises:

a fifth n-channel field-effect-transistor having a source for coupling to said video signal, a drain for coupling to said column line, and a gate coupled to the output of said third inverter; and a sixth p-channel field-effect-transistor having a source for coupling to said video signal, a drain for coupling to said column line, and a gate coupled to the output of said second inverter.

7. A video switch according to claim 6 wherein said output compensating circuit comprises:

a seventh p-channel field-effect-transistor having a source and drain for coupling to said column line and having a gate coupled to the output of said third inverter; and an eighth n-channel field-effect-transistor having a source and drain for coupling to said column line and having a gate coupled to the output of said second inverter.

8. A video switch according to claim 7 wherein said first inverter comprises:

a ninth n-channel field-effect-transistor having a gate for coupling to said control signal, a source for coupling to said third potential, and a drain coupled to the input of said current mirror level shifter; and a tenth p-channel field-effect-transistor having a gate for coupling to said control signal, a source for coupling to said first potential, and a drain coupled to the input of said current mirror level shifter.

9. A video switch according to claim 8 wherein said second inverter comprises:

an eleventh n-channel field-effect-transistor having a gate coupled to the output of said current mirror level shifter, a source for coupling to said third potential, and having a drain; and a twelfth p-channel field-effect-transistor having a gate coupled to the output of said current mirror level shifter, a source for coupling to said second potential, and a drain coupled to the drain of said eleventh n-channel field-effect-transistor.

10. A video switch according to claim 9 wherein said third inverter comprises:

a thirteenth n-channel field-effect-transistor having a gate coupled to the output of said second inverter, a source for coupling to said third potential, and a drain coupled to the gate of said fifth n-channel field-effect-transistor and to the gate of said seventh p-channel field-effect-transistor; and a fourteenth p-channel field-effect-transistor having a gate coupled to the output of said second inverter, a source for coupling to said second source of potential, and a drain coupled to the drain of said thirteenth n-channel field-effect-transistor.

11. A video switch according to claim 1 wherein said second potential is substantially greater than said first potential.

12. A video switch according to claim 2 wherein said video signal is a digital video signal.

13. An LCD display for generating an image of a video signal, said LCD display being of the type which includes a matrix of pixels arranged in a plurality of rows and a plurality of columns which are selectively energized to create said image, comprising:

a first row select circuit for energizing each of said rows in accordance with a first predetermined sequence; and a column select circuit for coupling said video signal to each of said columns in accordance with a second predetermined sequence, said column select circuit comprising a plurality of video switches, each video switch comprising:

a current mirror level shifter having an output and having an input coupled to receive a control signal for shifting said control signal from a first potential to a second potential at said output; and a transmission gate coupled to said current mirror level shifter for coupling said video signal to one of said plurality of columns upon receipt of said control signal having said second potential.

14. LCD display according to claim 13 wherein each of said plurality of rows has a first end coupled to said first row select circuit and wherein each of said plurality of rows has a second end, said LCD display further comprising a second row select circuit coupled to said second end of each of said plurality of rows.

15. An LCD display according to claim 14 wherein said column select circuit includes a first shift register having an input coupled to receive said control signal and having a plurality of outputs each coupled to one of said plurality of columns for sequentially applying said video signal to said plurality of video switches.

16. An LCD display according to claim 14 wherein said video switch further comprises an output compensating circuit coupled to said transmission gate for improving the integrity of said video signal at said column line.

17. An LCD display according to claim 16 wherein said video switch further comprises a first inverter having an input coupled to receive said control signal and having an output coupled to the input of said current mirror level shifter.

18. An LCD display according to claim 17 wherein said video switch further comprises:

a second inverter having an input coupled to the output of said current mirror level shifter and having an output coupled to said transmission gate; and a third inverter having an input coupled to the output of said second inverter and having an output coupled to said transmission gate.

19. An LCD display according to claim 18 wherein said current mirror level shifter further comprises:

a first n-channel field-effect-transistor having a gate for coupling to a first potential, a drain coupled to the output of said first inverter, and having a drain;

a second p-channel field-effect-transistor having a drain coupled to the drain of said first n-channel field-effect-transistor and to the gate of said second p-channel field-effect-transistor, and having a source for coupling to a second potential, said second potential being higher than said first potential;

a third n-channel field-effect-transistor having a gate coupled to the output of said first inverter and to the source of said first n-channel field-effect-transistor, a source for coupling to a third potential, and a drain coupled to the output of said current mirror level shifter; and a fourth p-channel field-effect-transistor having a gate coupled to the gate of said second p-channel field-effect-transistor, a source for coupling to said second potential, and a drain coupled to the drain of said third n-channel field-effect-transistor and to the output of said current mirror level shifter.

20. An LCD display according to claim 19 wherein said transmission gate comprises:

a fifth n-channel field-effect-transistor having a source for coupling to said video signal, a drain for coupling to said column line, and a gate coupled to the output of said third inverter; and a sixth p-channel field-effect-transistor having a source for coupling to said video signal, a drain for coupling to said column line, and a gate coupled to the output of said second inverter.

21. An LCD display according to claim 20 wherein said compensating circuit comprises:

a seventh p-channel field-effect-transistor having a source and drain for coupling to said column line and having a gate coupled to the output of said third inverter; and an eighth n-channel field-effect-transistor having a source and drain for coupling to said column line and having a gate coupled to the output of said second inverter.

* * * * *